United States Patent [19]

Dederick

[11] 4,216,900

[45] Aug. 12, 1980

[54] COLLAPSIBLE BAG WITH ENLARGABLE OPENING

[76] Inventor: Robert J. Dederick, 290 River Rd., Port Ewen, N.Y. 12466

[21] Appl. No.: 2,639

[22] Filed: Jan. 11, 1979

[51] Int. Cl.[2] ..... B65D 33/02

[52] U.S. Cl. ..... 229/55; 229/65

[58] Field of Search ..... 229/65, 55, DIG. 3; 206/627

[56] References Cited

U.S. PATENT DOCUMENTS

| | | | |
|---|---|---|---|
| 642,302 | 1/1900 | Davis | 229/65 |
| 1,719,347 | 7/1929 | Weinstein et al. | 229/65 |
| 1,751,755 | 3/1930 | Paris | 206/627 X |
| 2,269,796 | 1/1942 | Strasser | 229/55 X |
| 2,333,123 | 11/1943 | Ringler | 229/62 X |
| 2,344,359 | 3/1944 | Lehmann | 229/62 X |
| 2,400,716 | 5/1946 | Sattler | 229/55 X |
| 2,904,169 | 9/1959 | Keating | 229/55 X |

FOREIGN PATENT DOCUMENTS

| | | | |
|---|---|---|---|
| 641069 | 12/1963 | Belgium | 229/55 |
| 458893 | 8/1950 | Italy | 229/DIG. 3 |
| 94989 | 12/1938 | Sweden | 229/DIG. 3 |
| 429241 | 5/1935 | United Kingdom | 229/55 |
| 614223 | 12/1948 | United Kingdom | 229/53 |
| 615494 | 1/1949 | United Kingdom | 229/53 |

*Primary Examiner*—Stephen P. Garbe

*Attorney, Agent, or Firm*—Sughrue, Rothwell, Mion, Zinn and Macpeak

[57] ABSTRACT

The collapsible bag is provided with bellows type folds along two opposed sides of the substantially rectilinear bag and a third side of the bag is connected to the two opposed sides by a pair of foldable gussets to allow for an extra large opening at one end of the bag to facilitate the removal of the contents from the bag. The bag may then be refolded into its initial substantially rectilinear shape and the end of the bag may be folded down to a reduced rectilinear size depending upon the volume of the contents left in the bag. After folding down the end of the bag the same may be secured by folding over the ends of a wire which is secured in and extends beyond the folded over end edge of the fourth side of the bag. Suitable stiffening members may be inserted into two sides of the bag and may be either removed or folded down as the contents of the bag diminish to facilitate the reduction in the size of the bag.

3 Claims, 7 Drawing Figures

FIG. 1
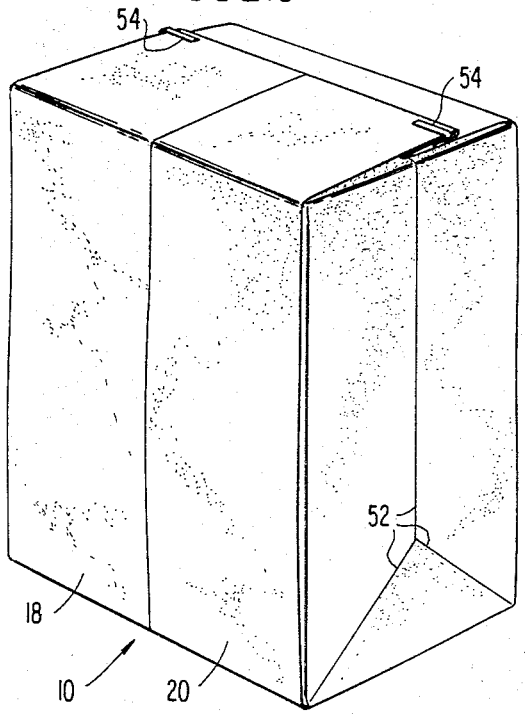
FIG. 2
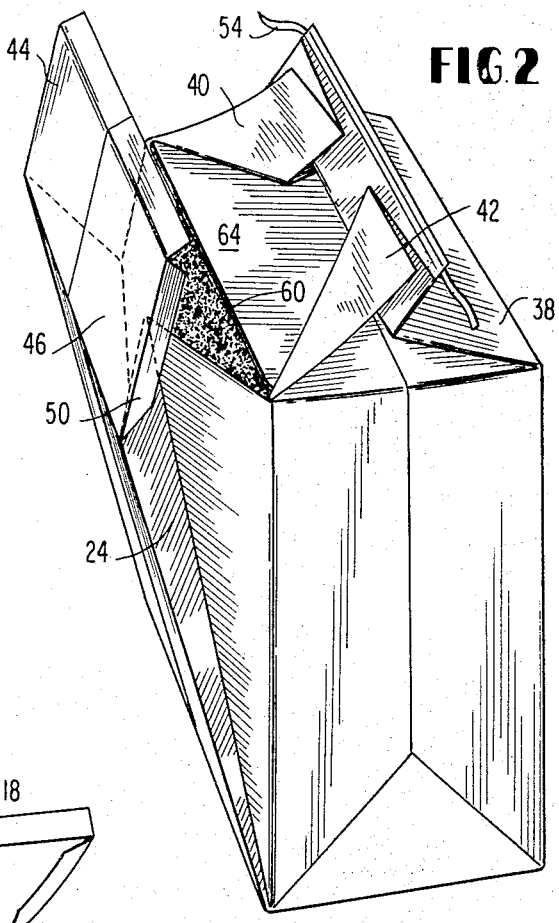
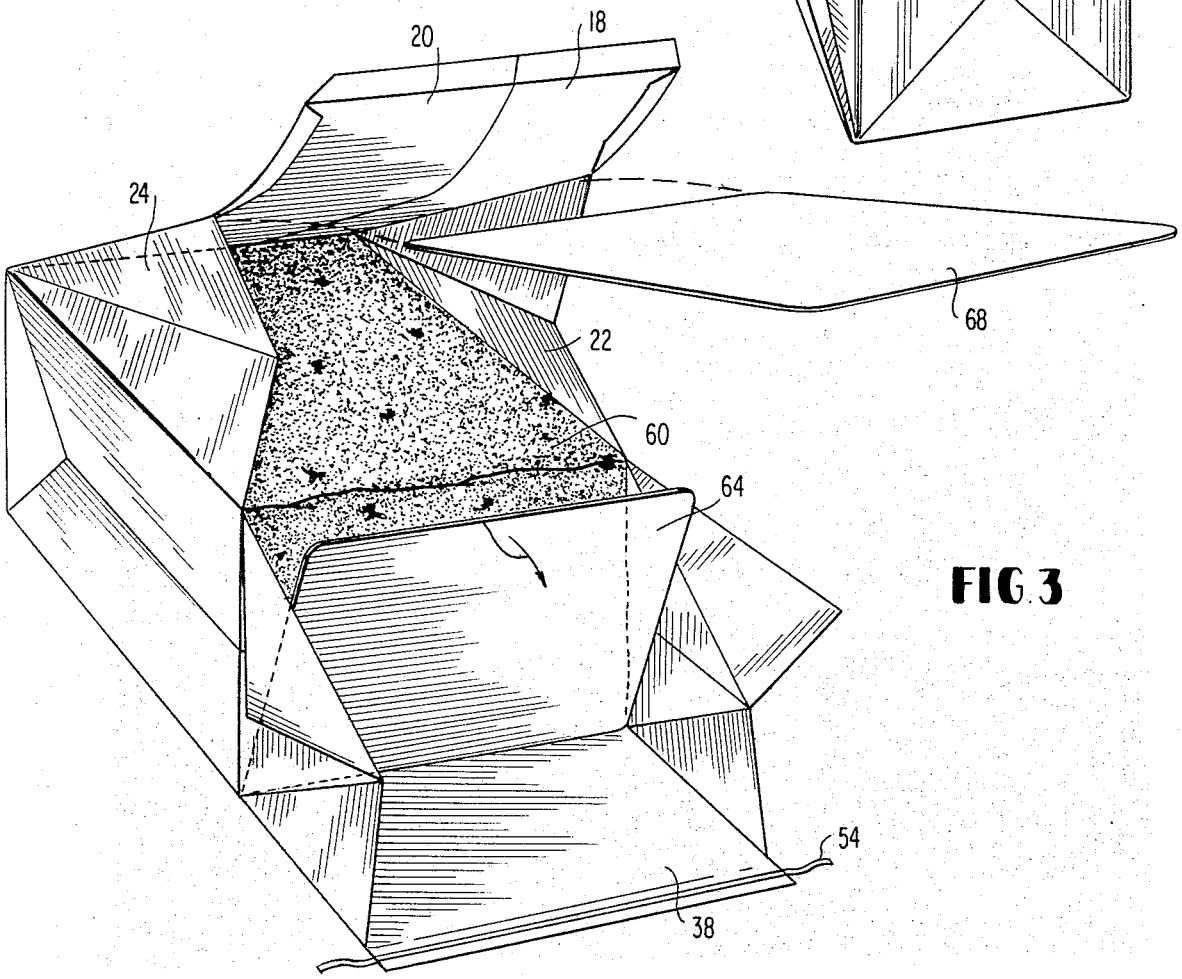
FIG. 3

FIG. 5
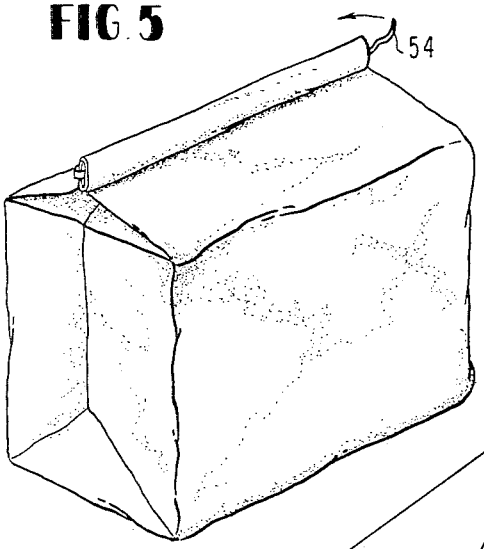
FIG. 4
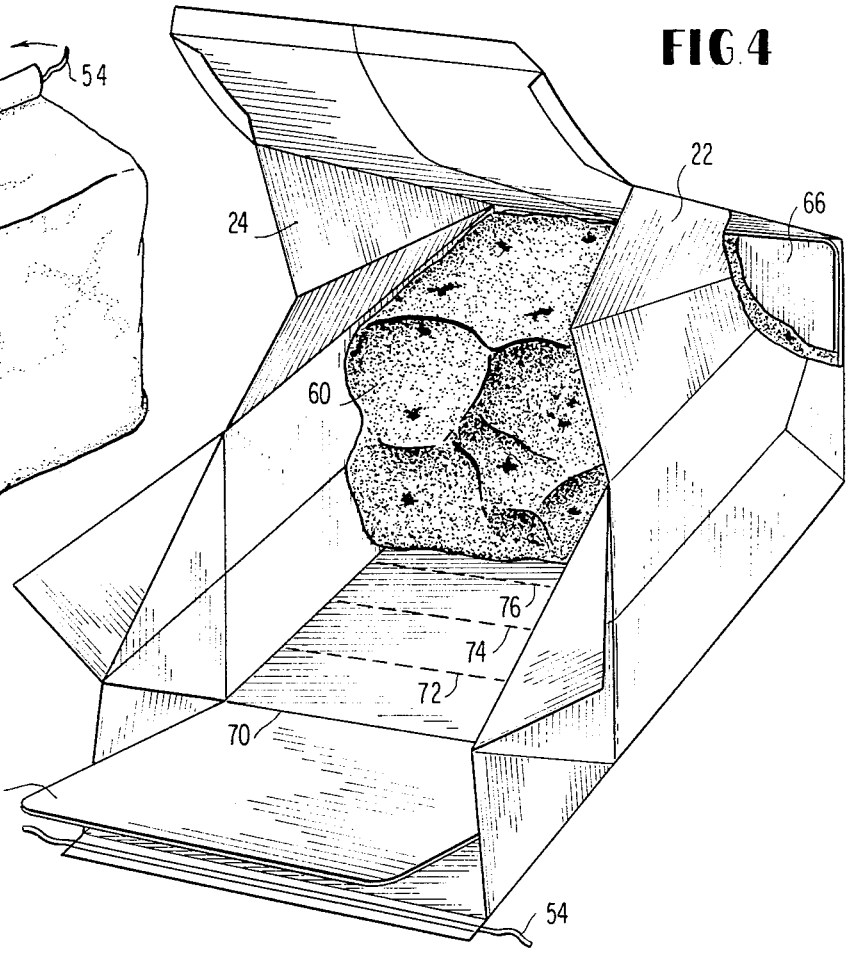
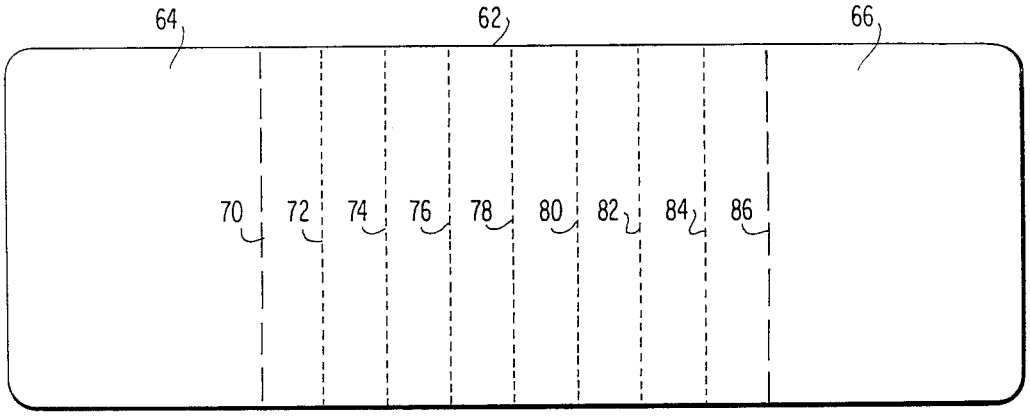
FIG. 6

COLLAPSIBLE BAG WITH ENLARGABLE OPENING

BACKGROUND OF THE INVENTION

1. Field of the Invention

The present invention is directed to collapsible bags and more specifically to collapsible bags having foldable gussets to provide an enlarged end opening to facilitate the removal of the contents of the bag.

2. Prior Art

The U.S. Pat. Nos. to Oliver 2,591,918 and Rochette 3,537,636 are each directed to a recloseable bag or package which may be reduced in size and which is provided with fastening means which will hold the bag closed in its reduced size as well as when the bag is full size.

The U.S. Pat. Nos. to Gatlin 1,236,159 and Weinstein et al 1,719,347 each show a substantially rectilinear bag having a bendable metallic strip or wire secured in and extending beyond a folded over end portion of one of the sides of the bag whereby the top of the bag can be folded down and secured by bending the metal strip or wire about the folded over portion. The following Patents each disclose rectilinear cartons or bags having a foldable wall arrangement at one end which may be opened for the removal of the contents. The opening in each case is either less than or equal to the rectilinear dimensions of the foldable end wall.

U.S. Pat. No. 1,498,673—R. S. Reynolds
U.S. Pat. No. 2,132,925—D. Bensel
U.S. Pat. No. 2,333,123—W. A. Ringler
U.S. Pat. No. 2,687,840—R. H. Innes
U.S. Pat. No. 2,799,442—R. E. Van Rosen
U.S. Pat. No. 3,481,524—G. E. Ruud et al

SUMMARY OF THE INVENTION

The present invention is directed to a new and improved collapsible bag construction having foldable gusset means which will permit one side of the bag to be opened as well as one end of the bag to provide an extra large opening for removing the contents of the bag. The side of the bag may then be folded to restore the bag to its normal rectilinear configuration and the open end of the bag can then be folded down into close proximity to the remaining contents and secured in place by an elongated bendable wire strip. Rectangular stiffening members may be inserted into the bag and may be provided with score lines to allow the stiffening strips to be folded or torn off as the contents of the bag are reduced so that the stiffening members will not interfere with the refolding of the bag.

The foregoing and other objects, features and advantages of the invention will be apparent from the following more particular description of a preferred embodiment of the invention as illustrated on the accompanying drawings.

BRIEF DESCRIPTION OF THE DRAWINGS

FIG. 1. is a perspective view of the collapsible bag according to the present invention in its closed filled condition.

FIG. 2 is a perspective view of the collapsible bag according to the present invention in its partially opened condition.

FIG. 3 is a perspective view of the collapsible bag according to the present invention in its substantially fully opened position.

FIG. 4 is a perspective view of the collapsible bag according to the present invention in its substantially fully opened condition with a portion of the contents thereof removed.

FIG. 5 is a perspective view of the collapsible bag in its closed collapsed condition with a reduced amount of contents therein.

FIG. 6 is a plan view of a stiffener member for the bag according to the present invention.

DETAILED DESCRIPTION OF THE PREFERRED EMBODIMENT

Figure 7:
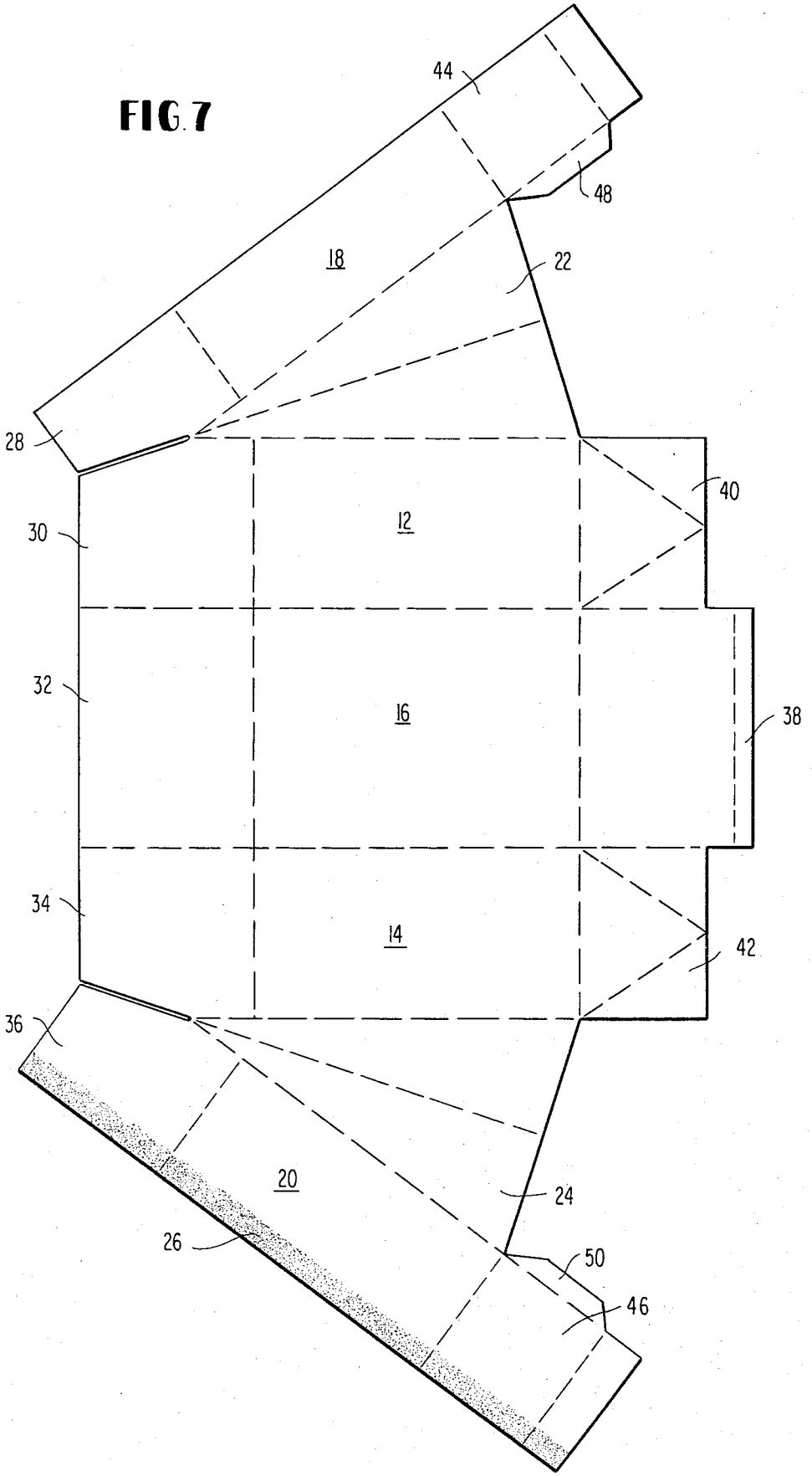
FIG. 7 is a plan view of the blank from which the collapsible bag according to the present invention may be constructed.

The collapsible bag 10 as shown in FIG. 1 is illustrated in the completely filled and closed condition wherein the bag has a substantially rectilinear configuration. The bag 10 is formed from the blank shown in FIG. 7 which includes a pair of side panels 12 and 14 disposed on opposite sides of a front panel 16. The rear panel is comprised of two panels 18 and 20 which are secured to the side panels 12 and 14 by foldable gussets 22 and 24. The panels 18 and 20 are secured together by adhesive means 26 to form the rear panel which is identical in size to the front panel 16. The bottom flaps 28, 30, 32, 34 and 36 which are connected to the panels 18, 12, 16, 14 and 20 respectively can be folded under and secured to each other in any suitable manner to provide the bottom of the bag. The front panel 16 is provided with a top flap 38 which extends outwardly beyond the top flaps 40 and 42 which are connected to the side panels 12 and 14 respectively. The two flaps 44 and 46 which are connected to the panels 18 and 20 respectively are secured together to provide a single top flap which is an extension of the rear panel formed by the panels 18 and 20. The tabs 48 and 50 on the top flaps 44 and 46 cooperate with the top flaps 40 and 42 when all the top flaps are brought together to provide a neater more complete closure.

The blank shown in FIG. 7 is of one piece construction and is cut from any suitable paper stock depending upon the nature of the contents for the package. The various dash lines shown in FIG. 7 each represent a fold line which may or may not be marked or precreased depending upon the thickness of the stock and/or the nature of the printing, labeling or other markings to be placed on the external surface of the bag. If the bag is to be used for ice cream or sherbert or the like, a 50–70 pound double faced coated stock should be sufficient. Additional fold lines could be provided on the side panels 12 and 14 similar to the fold lines 52 shown in FIG. 1 if it is desirable to have a bellows type construction for the bag. Such a bellows type construction would be desirable if the bag is to be stored in flat condition prior to being filled with the desired contents.

In order to form the blank shown in FIG. 7 into a bag suitable for receiving the contents, such as a brick of ice cream as shown in FIGS. 2 and 3, the panels 18–24 would each be folded about their connecting fold lines and the panels 18 and 20 would be joined together by the adhesive means 26. The bottom flaps 28–36 would then be folded together in overlapping relation and secured to each other by any suitable means such as adhesives or the like. The protruding end of the top flap 38 is folded over upon itself with a bendable wire strip disposed in the fold. The folded over portion is adhesively secured to itself to secure the bendable wire strip 54 in place. The bendable wire strip 54 is of such a length as to have the ends thereof extending outwardly beyond the side edges of the top flap 38. This insertion and securing of the strip 54 can take place either before or after the folding of the blank to form the bag depending upon the type of automatic folding machinery involved.

At this stage the bag would appear substantially as shown in FIG. 3. The gussets 22 and 24 permit the rear side which is comprised of joined together panels 18 and 20 to be opened to a wide extent which will permit the ready insertion of a product, such as a brick of ice cream, sherbert or the like. In order to facilitate the handling of a brick of ice cream and to provide additional stiffness for the package, the brick of ice cream 60 may be placed on a stiffening member 62 such as that shown in FIG. 6. The end portions 64 and 66 of the stiffening member 62 would be dimensioned so that upon being folded upwardly at right angles they would be coextensive with the end of the brick of ice cream 60 as best shown in FIG. 3. An additional stiffener member 68 which is coextensive in size with the top of the ice cream brick 60 would then be inserted between the back side and the partially folded or collapsed gussets 22 and 24.

With the bag filled with the desired contents, such as the ice cream brick 60 the three top flaps 38, 40 and 42 would be folded in the manner shown in FIG. 2 and the top flaps 44 and 46 would be brought into engagement with the flaps 40 and 42 respectively. The tabs 48 and 50 would be folded about the side edges of the flaps 40 and 42. At this stage the gussets 22 and 24 would be folded completely flat into engagement with the contents of the package. The top edges of the flaps 44, 46 and 38 would then be folded together, the ends of the bendable wire would be turned back to secure the fold and the entire folded top could then be pressed into the flattened position shown in FIG. 1 to provide a substantially rectilinear package.

When it is desired to remove the contents of the bag a reverse procedure would then be followed. As best seen in FIG. 4, the extra large opening provided by the top flaps and the gussets 22 and 24 permit ready access to the contents for removal of the same. In FIG. 4 the end piece 64 could be then torn off along the line 70 and the bottom portion of the stiffener 62 could then be folded upwardly at right angles along the line 76 into engagement with the end of the remaining portion of the ice cream brick. The various lines 70–86 could either be merely guide markings or could be scored or perforated to assist in tearing off or folding of the strip. It would not be necessary to reinsert the reinforcing member 68 but similar fold or tear lines could be provided on the strip 68 if it was desirable to replace the stiffening member in the movable side wall of the bag. The movable side wall and the end walls would then be folded into closed condition in a manner similar to that described above for closing a full package. However, prior to bending the strip 54 into locking engagement with the folded flaps, the entire unfilled portion of the bag would be folded down into engagement with the remaining product in the bag. The ends of the strip 54 would then be bent into securing relationship with the folded down portion as shown in FIG. 5 to provide a bag of reduced dimensions commensurate with the volume of the contents remaining therein. Thus, in the case of ice cream or other frozen products, the reduced size package will provide a saving of space in the freezer and it is also possible to tell by merely glancing at the size of the bag how much of the product remains in the bag.

The use of the bag with frozen products such as ice cream, sherbert or the like is only by way of illustration and it is obvious that the bag could be used for numerous other products which may be solid, granular, chunky, pasty or the like. The material of the bag would vary depending upon the nature of the contents and could conceivably vary from a flimsy lightweight stock to a relatively heavy stiff stock. Instead of inserting a solid ice cream brick into the expanded bag, the ice cream could be injected into the bag in a semi-liquid state and then be frozen to solidify the contents. It is also conceivable that additional gussets could be inserted between the front panel and the two side panels to provide an added degree of expansibility. The initial folding and closing of the bag as well as the subsequent refolding and closing of the bag to a reduced size provide complete sealing to prevent deterioration of the contents. Although a feature of the present invention is the collapsibility of the bag, the construction would still be advantageous even if not collapsible due to the improved access provided by the foldable end flaps and gusseted side wall.

While the invention has been particularly shown and described with reference to a preferred embodiment thereof, it will be understood by those in the art that various changes in form and details may be made therein without departing from the spirit and scope of the invention.

What is claimed is:

1. A bag comprising a sheet of flexible material folded upon itself with opposed edges thereof connected together to define a hollow substantially rectilinear tube having front, rear and a pair of side walls, bottom flap means integral with said walls secured together in overlapping relation to define a bottom wall, top flap means integral with said walls being foldable to define top closure means which may be opened and closed, fastening means for securing said top closure means in closed condition and gusset means disposed between said side walls and at least one of said front and rear walls to provide an enlarged opening in conjunction with the opening formed by said top flap means, stiffening means inserted into said bag for partially surrounding the contents, said stiffening means being comprised of a side panel and two end panels integral therewith, said side panel having transverse weakened lines formed therein along which said stiffening means may be reduced in size as the contents of the bag are removed so the bag may be readily folded to a smaller size without interference from said stiffening means.

2. A bag as set forth in claim 1, wherein said fastening means is comprised of an elongated bendable metal piece secured along the free edge of the top flap of one of said front and rear walls, said bendable metal piece having the ends thereof protruding beyond the side edges of said flap so that upon folding the top flap means into close proximity to the contents of the package, the bendable metal piece may be bent about the folded top flap means to secure the same in closed condition.

3. A bag as set forth in claim 1, wherein said side walls and top flap means integral therewith are provided with fold lines to assist in forming a bellows arrangement in said side walls and a gable type fold in said top flap means.

* * * * *